US011168945B2

(12) United States Patent
Zhang et al.

(10) Patent No.: US 11,168,945 B2
(45) Date of Patent: Nov. 9, 2021

(54) PREPARATION METHOD OF LOOP HEAT PIPE EVAPORATOR

(71) Applicant: BEIJING INSTITUTE OF SPACECRAFT SYSTEM ENGINEERING, Beijing (CN)

(72) Inventors: Hongxing Zhang, Beijing (CN); Guanglong Man, Beijing (CN); Guoguang Li, Beijing (CN); Jingtuzhi Li, Beijing (CN)

(73) Assignee: Beijing Institute of Spacecraft System Engineering, Beijing (CN)

( * ) Notice: Subject to any disclaimer, the term of this patent is extended or adjusted under 35 U.S.C. 154(b) by 123 days.

(21) Appl. No.: 16/513,037

(22) Filed: Jul. 16, 2019

(65) Prior Publication Data

US 2020/0011611 A1 Jan. 9, 2020

Related U.S. Application Data

(63) Continuation of application No. PCT/CN2017/000125, filed on Jan. 20, 2017.

(30) Foreign Application Priority Data

Jan. 16, 2017 (CN) ..... 201710029335.X

(51) Int. Cl.
*F28D 15/04* (2006.01)
*B22F 3/14* (2006.01)
(Continued)

(52) U.S. Cl.
CPC ..... *F28D 15/046* (2013.01); *B22F 3/14* (2013.01); *B22F 5/106* (2013.01); *F28D 15/0283* (2013.01); *F28D 15/043* (2013.01)

(58) Field of Classification Search
CPC .... B22F 3/14; B22F 3/11; B22F 5/106; B22F 7/004; B22F 7/06; B22F 2005/103;
(Continued)

(56) References Cited

FOREIGN PATENT DOCUMENTS

CN 106288530 A * 1/2017 ..... F28D 15/0266

OTHER PUBLICATIONS

Machine Translation for CN-106288530-A (Year: 2017).*

* cited by examiner

*Primary Examiner* — Christopher J Besler
*Assistant Examiner* — Christine Bersabal
(74) *Attorney, Agent, or Firm* — Yong Chen

(57) ABSTRACT

A hot-press sintering method to prepare a loop heat pipe evaporator includes: putting a shell of the evaporator into a mould, uniformly and compactly filling corresponding positions in the mould with material powders of an evaporation core, a heat insulation core and a transmission core, applying a pressure high enough to tightly fit the evaporation core and the transmission core to the shell at corresponding sintering temperatures of powder materials for the evaporation core and the transmission core, carrying out hot-press sintering for molding, carrying out cooling after metallurgically bonding the powder materials of the evaporation core and the transmission core, and carrying out demolding to obtain the loop heat pipe evaporator, wherein the mould is provided with corresponding structures shaped like steam channels on positions where the evaporation core is provided with the steam channels.

8 Claims, 11 Drawing Sheets

(51) Int. Cl.
*B22F 5/10* (2006.01)
*F28D 15/02* (2006.01)

(58) Field of Classification Search
CPC .. F28D 15/046; F28D 15/0283; F28D 15/043;
F28D 15/0233; F28F 2255/18
See application file for complete search history.

PREPARATION METHOD OF LOOP HEAT PIPE EVAPORATOR

CROSS-REFERENCE TO RELATED APPLICATIONS

This application is a continuation of international patent application PCT/CN2017/000125, filed Jan. 20, 2017, which claims priority to Chinese patent application No. 201710029335.X filed Jan. 16, 2017. The disclosure of each of these prior-filed applications is incorporated by reference herein in its entirety.

FIELD

The present disclosure relates to a preparation method of a loop heat pipe evaporator and belongs to the technical field of heat control.

BACKGROUND

A loop heat pipe is efficient two-phase heat transfer equipment, has the characteristics such as high heat transfer performance, long-distance heat transmission, good temperature control characteristic, random pipeline bending and convenience in mounting and has a very wide application prospect in various fields such as aviation, spaceflight and ground electronic equipment due to advantages which cannot be compared with various other heat transfer equipment (Hongxing Zhang, Theorical and Experimental Researches on a Two-Phase Heat Transfer Technology of a Loop Heat Pipe, doctoral dissertation, Beijing University of Aeronautics and Astronautics, 2016).

The loop heat pipe mainly comprises an evaporator, a condenser, a liquid storage device, a steam pipeline and a liquid pipeline. The whole circulation process is as follows: a liquid is evaporated on the outer surface of a capillary core in the evaporator to absorb heat outside the evaporator, the generated steam flows from the steam pipeline to the condenser and releases heat in the condenser to a heat sink so as to be condensed to form a liquid which finally flows into the liquid storage device by the liquid pipeline, and a liquid working medium in the liquid storage device supplies to the capillary core in the evaporator.

Due to the small mounting space required by a flat loop heat pipe and the convenience to mount a flat evaporator and a heat source on a plane, flat loop heat pipe is a research hotspot and a key application direction in recent years. The flat loop heat pipe has primarily two types according to difference in their structures. The first type is a disc-shaped flat loop heat pipe, where the evaporator is disc-shaped and is isolated from the liquid storage device by the capillary core (R. Singh et al., Operational characteristics of a miniature loop heat pipe with flat evaporator, International Journal of Thermal Sciences (2008), doi:10.1016/j.ijthermalsci. 2007.12.013.). The second type is a rectangular flat loop heat pipe, where the liquid storage device is arranged at one side of the evaporator (Yu. Maydanik*, S. Vershinin, M. Chernysheva, S. Yushakova, Investigation of a compact copper water loop heap pipe with a flat evaporator, Applied thermal Engineering, 31(2011), 3533-3541.).

The capillary core is a core component of the loop heat pipe evaporator and has the following main functions: on one hand, the contact surface of the capillary core with a porous structure and the heat source is used as an evaporation surface, a capillary pinhole on the evaporation surface forms a meniscus surface to provide a capillary driving force for driving a working medium to circulate, and a liquid in the liquid storage device is drawn into the evaporator again by the capillary core after circularly flowing into the liquid storage device. On the other hand, the evaporator and the liquid storage device are sealed and isolated by the capillary core, so that the steam is only capable of circulating from an outer loop, preventing the gas generated by the evaporator from entering the liquid storage device after penetrating through the capillary core to thereby result in circulation failure.

In order to improve the heat transfer performance, starting performance and operation stability of the loop heat pipe, the capillary core needs to satisfy two requirements:

(1) from the standpoint of improving the heat transfer performance, the evaporation side of the capillary core should have a relatively high heat conducting coefficient to improve the evaporation and heat exchange performances and reduce the evaporation and heat exchange temperature difference; meanwhile, the capillary core should have relatively small capillary pore diameter to increase the capillary driving force and improve the maximum heat transfer capability of the loop heat pipe; and (2) from the standpoint of improving the starting performance and the operation stability, the capillary core should have a relatively low heat conducting coefficient to reduce heat leaked from the evaporator to the liquid storage device to form a temperature difference (namely pressure difference) of the evaporator and the liquid storage device; meanwhile, the capillary core should have a relatively large capillary pore diameter to improve the permeability and reduce the flowing resistance of the liquid from the liquid storage device to the evaporator.

The two requirements conflict with each other. In order to solve the problem, a structure with double-layer capillary cores with different pore diameters and heat conducting coefficients is used in literature and patent documents published domestically and abroad. A structure having a double-layer capillary cores is proposed in such documents. The capillary core at the evaporation side is formed by sintering a powder with a small particle size and a high heat conducting coefficient, and the capillary core at the liquid supply side is formed by sintering a powder with a large particle size and a low heat conducting coefficient (Shuangfeng Wang, Experimental research on miniature flat loop heat pipe for display card heat radiation, 2012, Lizhan Bai, Guiping Lin, Heat transfer and flow characteristic analysis of composite core of loop heat pipe, Journal of Beijing University of Aeronautics and Astronautics, V35 (12), December, 2009. Li Qiang research on heat transfer characteristic of capillary evaporator with composite structure, 2015).

The double-layer capillary cores are theoretically feasible, but have the two issues in implementation: 1) the two capillary cores are difficult to integrally sinter due to different sintering temperatures, the interfaces of different metals are difficult to bond, and liquid supply for the capillary cores will be blocked once air bubbles or steam is generated at the gap; and 2) it is also more difficult to isolate and seal the evaporator and the liquid storage device by adopting the double-layer capillary cores.

SUMMARY

To overcome the deficiencies of the prior art, the present disclosure aims at providing a preparation method of a loop heat pipe evaporator. The composite capillary core in the evaporator has a three-layer composite structure, so that heat leaked towards a liquid storage device can be effectively reduced, the permeability is improved while the capillary force is increased. Hence the technical problem that it is difficult to improve the heat transfer performance, the starting performance and the operation stability while increasing the heat conducting coefficient and permeability of the capillary core of the loop heat pipe, is solved.

The object of the present disclosure is achieved by the following technical solution.

The present disclosure discloses the preparation method of the loop heat pipe evaporator, and the evaporator is composed of a shell and a composite capillary core, wherein the composite capillary core is formed by sequentially compounding three layers including an evaporation core, a heat insulation core and a transmission core, wherein the heat insulation core is located between the evaporation core and the transmission core, the side not adjacent to the heat insulation core of the evaporation core is provided with the steam channels, and the side not adjacent to the heat insulation core of the transmission core is disposed proximal to a liquid storage device of the loop heat pipe; the evaporation core and the transmission core are made of the same material of which the heat conducting coefficient is larger than that of the material of the heat insulation core and the melting point is lower than that of the material of the heat insulation core; the melting point of the material of the shell is greater than or equal to that of the material of the evaporation core and the transmission core.

The evaporation core is prepared by carrying out hot-press sintering on a powder material of which the particle size is preferably 300-1000 meshes, so that a large capillary force is provided; the transmission core is prepared by carrying out hot-press sintering on a powder material of which the particle size is larger than or equal to that of the powder material of the evaporation core and is preferably 50-300 meshes, so that high permeability is provided; and the material of the evaporation core and the transmission core is preferably copper, nickel or aluminum.

The heat insulation core uses a powder material of which the particle size is preferably 50-300 meshes, and the material is preferably stainless steel, titanium, titanium alloy or a metal oxide.

Preferably, the heat conducting coefficient of the material of the evaporation core and the transmission core is an order of magnitude different from that of the material of the heat insulation core, and preferably, the difference of the melting point of the material of the heat insulation core and the melting point of the material of the evaporation core and the transmission core is greater than 100° C.

The evaporation core and the transmission core are placed in the shell and are molded by hot-press sintering and are tightly fitted with the wall surface of the shell to realize a tight seal, and the heat insulation core which is sandwiched in the center is kept in a powdery state.

Preferably, the shape of the evaporator is a rectangular planar, disc-shaped planar, or cylindrical.

Preferably, the steam channels are rectangular, circular or trapezoidal; more preferably, the steam channels are circular and are uniformly distributed on the evaporation core.

The thickness of the shell of the evaporator is preferably smaller than 1 mm.

The preparation method is a hot-press sintering method comprising the specific steps as follows:

putting the shell into a mould, then, uniformly and compactly filling corresponding positions in the mould with the material powders of the evaporation core, the heat insulation core and the transmission core, applying a pressure high enough to tightly fit the evaporation core and the transmission core to the shell at corresponding sintering temperatures of the powder materials for the evaporation core and the transmission core, carrying out hot-press sintering for molding, carrying out cooling after sufficiently sintering the powder materials of the evaporation core and the transmission core to form metallurgical bonding between powders, and carrying out demolding to obtain the loop heat pipe evaporator, wherein the mould is provided with corresponding structures shaped like steam channels on positions where the evaporation core is provided with the steam channels.

The operation of molding by hot-press sintering is performed under conventional conditions in the prior art and is generally performed in vacuum or in the presence of a protective gas, where the protective gas is generally nitrogen (N2) or argon (Ar); a reducing gas (such as hydrogen) is required to be introduced for reduction when the powder material used for the evaporation core and the transmission core is an easily-oxidized metal (such as copper); and hot-press sintering may be performed by using a sintering furnace.

Preferably, the mould comprises a position limiting tool, steam channel molding tools and a pressure application tool, the structures and shapes of the tools are designed according to the structure and shape of the composite capillary core of the present disclosure, and the tools are used together.

When the evaporator is the rectangular flat evaporator or the disc-shaped flat evaporator, the preparation method comprises the steps as follows:

(1) assembling the steam channel molding tools on the limiting tool, and fixing the shell on the limiting tool;

(2) uniformly and compactly filling the shell with the powder material of the evaporation core, and making the side provided with the steam channels of the evaporation core be in tight contact with the steam channel molding tools;

(3) uniformly and compactly filling the side not provided with the steam channels of the evaporation core in the shell with the powder material of the heat insulation core;

(4) uniformly and compactly filling one side of the heat insulation core in the shell with the powder material of the transmission core;

(5) inserting the pressure application tool into the shell, and putting the pressure application tool to the outer side of the material of the transmission core to obtain an assembled mould and a composite capillary core material;

(6) putting the assembled mould and the composite capillary core material into the sintering furnace, and applying a pressure to the outer side by the pressure application tool so as to carry out hot-press sintering for molding;

(7) demolding after molding, and packaging the top of the shell to obtain a rectangular flat or disc-shaped flat loop heat pipe evaporator.

When the evaporator is a cylindrical evaporator, the preparation method comprises the steps as follows:

(1) combining the shell with the limiting tool of the evaporation core, fixing the steam channel molding tools, keeping a distance between the bottoms of the steam channel molding tools to the bottom of the limiting tool of the evaporation core, distributing more than one of the steam channel molding tools around the shell, and fitting the more than one of the steam channel molding tools to the inner wall surface of the shell, wherein a gap of the shell and the limiting tool of the evaporation core is of a cylindrical structure and is used for filling the powder material of the evaporation core;

(2) filling the gap formed by combining the shell and the limiting tool of the evaporation core with the powder material of the evaporation core, applying a pressure by using the pressure application tool to compact the powder material of the evaporation core, and making the height of the compacted evaporation core smaller than that of the shell;

(3) removing the limiting tool of the evaporation core, mounting the limiting tool of the heat insulation core, and leaving a gap with a cylindrical structure between the limiting tool of the heat insulation core and the filled evaporation core;

(4) firstly filling the gap with the cylindrical structure in step (3) with the powder material of the evaporation core, then, filling the gap with the powder material of the heat insulation core, applying a pressure by the pressure application tools to compact the powder material of the heat insulation core, and making the height of the compacted heat insulation core consistent with that of the evaporation core;

(5) removing the limiting tool of the heat insulation core, mounting the limiting tool of the transmission core, and leaving a gap with a cylindrical structure between the limiting tool of the transmission core and the filled evaporation core and heat insulation core;

(6) filling the gap with the cylindrical structure in step (4) with the powder material of the transmission core, applying a pressure by the pressure application tool to compact the powder material of the heat insulation core, making the height of the transmission core greater than the heights of the heat insulation core and the evaporation core, and coating the outer sides of the tops of the evaporation core and the heat insulation core to obtain an assembled mould and a composite capillary core material;

(7) putting the assembled mould and the composite capillary core material into the sintering furnace, and applying a pressure to the outer side by the pressure application tool so as to carry out hot-press sintering for molding;

(8) demolding, and packaging the top of the shell to obtain a cylindrical loop heat pipe evaporator.

The present disclosure discloses a loop heat pipe mainly comprising an evaporator, a condenser, a liquid storage device, a steam pipeline and a liquid pipeline, wherein the evaporator is the loop heat pipe evaporator disclosed by the present disclosure.

Beneficial Effects

1. The present disclosure provides a preparation method of a loop heat pipe evaporator, the prepared evaporator has a three-layer composite capillary core, the evaporation core and the transmission core with metallurgical structures are formed by powder hot-press sintering, the heat insulation core which is not sintered and is powdery is sandwiched in the center, the evaporation core and the transmission core which are molded by sintering are tightly fitted with the wall surface of the shell to form a seal, so that the powdery heat insulation core can be sealed and fixed; in an unsintered powdery heat insulation core layer, on one hand, the powder is in point contact without metallurgical bonding, and due to the existence of contact heat resistance, the heat insulation core has higher heat resistance than the metallurgically bonded evaporation core and transmission core and is capable of better heat leakage reduction and better in heat insulation effect; on the other hand, compared with the metallurgically bonded evaporation core and transmission core, a loose-state powder layer of the heat insulation core also has higher permeability and is capable of effectively reducing heat leaked from the evaporator to the liquid storage device and improving the starting performance and operation stability of a product; and meanwhile, the circulation resistance inside the composite capillary core disclosed by the present disclosure is reduced, and the heat transfer performance of the product is improved.

2. The present disclosure provides a preparation method of a loop heat pipe evaporator, the evaporation core and the transmission core in the prepared composite capillary core may be formed by sintering powders with different particle sizes, the evaporation core with a small pore diameter can be used to increase the capillary driving force, meanwhile, the transmission core with a large pore diameter can be used to reduce the flow resistance of the capillary core, and finally, the heat transfer performance of the product is improved.

Figure 1:
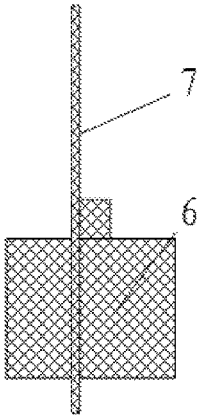
FIG. 1 is a left sectional view of an assembly formed after steam channel molding tools and a limiting tool are assembled in a process of preparing a rectangular flat loop heat pipe evaporator in embodiment 1.

In the drawings, the reference numerals refer to: 1—shell, 2—evaporation core, 3—heat insulation core, 4—transmission core, 5—steam channel, 6—limiting tool, 7—steam channel molding tool, 8—pressure application tool, 9—weight, 10—cold plate, 11—pipeline, 12—heater, 13—temperature measurement point, and 14—evaporator.

DETAILED DESCRIPTION OF THE EMBODIMENTS

Preferred implementation of the present disclosure is described in detail below.

The performance of a loop heat pipe evaporator 14 prepared in the following embodiments is tested, and a testing method is as follows:

(1) Capillary Force Testing:

A capillary force is tested according to "measurement of pore diameter for air bubble test of permeable sintered metal material in GB/T5249-2013", a tested evaporator 14 is sufficiently soaked into deionized water at 20° C., a high-pressure gas is gradually introduced to one end of the evaporator 14. and air bubbles emerging at the other end is observed. The pressure of the gas introduced to the evaporator 14 is recorded when a first air bubble emerges, and the pressure is the capillary force of the evaporator 14. Generally, the smaller the particle size is, the larger the capillary force is, and the tested capillary force should meet practical use requirements of the product.

Figure 24:
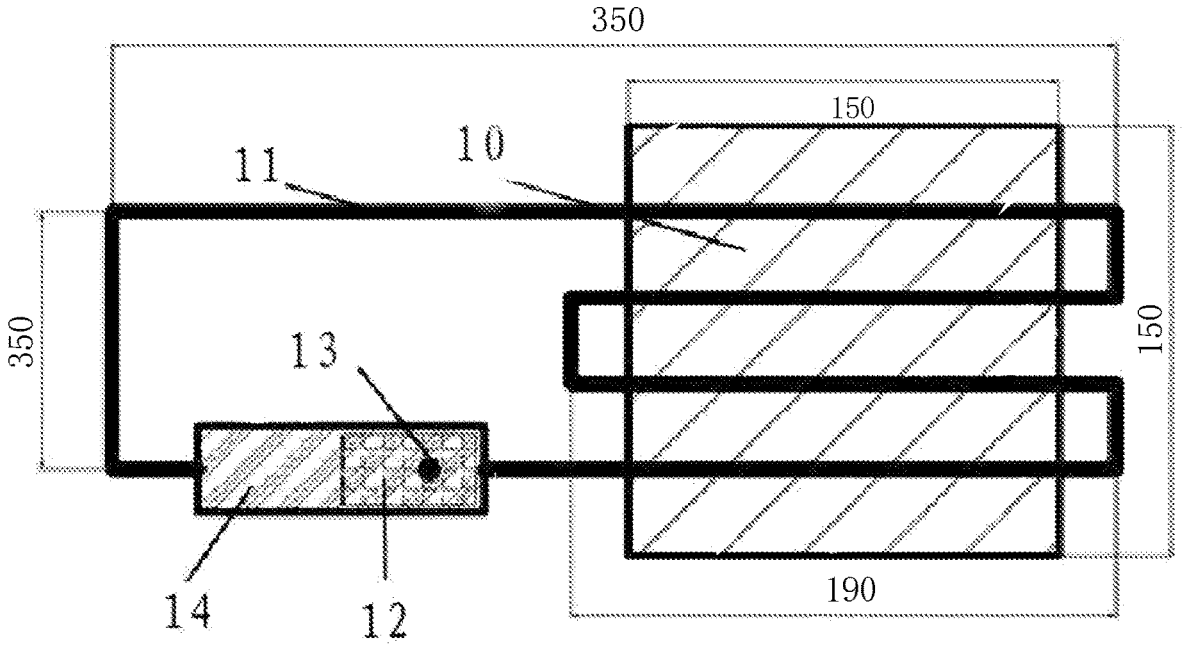
FIG. 24 is a structural schematic diagram of a heat transfer capability testing system in an embodiment.

(2) Heat Transfer Capability Testing:

System setup: a heat transfer capability testing system is composed of a heater 12, a cold plate 10, a pipeline 11 and a temperature measurement point 13, as shown in FIG. 24.

Principles: the evaporator 14 is mounted in the heat transfer capability testing system, the system is filled with a phase-change working medium, hot steam is formed at an outlet of the evaporator 14 after the evaporator 14 is heated by the heater 12, the pressure of the steam is gradually increased, a liquid in the system is driven to flow to transfer heat of the heater 12 to the cold plate 10 in a form of the hot steam so that the heat is cooled, the hot steam is condensed in the cold plate 10 to form the liquid, then, the liquid is transferred back to the evaporator 14 along the pipeline 11, and thus, the temperature of the evaporator 14 may be kept stable.

Wherein: the cold plate 10 is a copper metal plate, a U-shaped groove is formed in the surface of the plate, the pipeline 11 is embedded into the U-shaped groove, and the cold plate 10 is used for cooling the heat brought from the evaporator 14 by the liquid in the pipeline 11.

Pipeline 11: the pipeline 11 is made of stainless steel, has the external diameter of 3 mm and the wall thickness of 0.5 mm and is used for directionally transporting the liquid in the pipeline 11. The liquid in the system is transported to the cold plate 10 by the evaporator 14 and is returned from the cold plate 10 to the evaporator 14.

Heater 12: the heater 12 is a replacement component for testing and is used for replacing a component required to radiate heat in actual use, generally, a heat radiator is required to provide the required power, and the heater 12 is provided with a direct-current voltage-stabilized power supply. Generally, the area of the heater 12 is slightly smaller than that defined by steam channels 5 in the evaporator 14, and the area of the heater 12 used in the heat transfer capability testing system is 20 mm×20 mm.

Temperature measurement point 13: the temperature measurement point 13 is a T-shaped thermocouple, is used for monitoring the temperature of the evaporator 14 and is provided with a display during monitoring. The temperature measurement point 13 is only fitted to the surface of the evaporator 14.

The heat transfer capability is tested using a GB/T 14812-2008 heat pipe heat transfer performance testing method.

Embodiment 1

Figure 2:
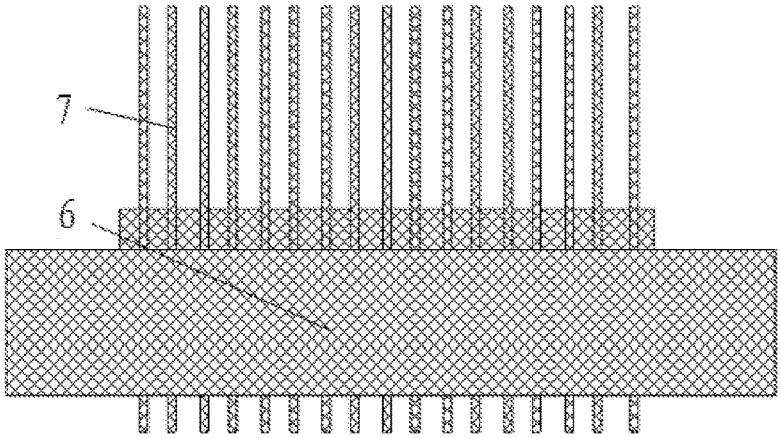
FIG. 2 is a main sectional view of an assembly formed after the steam channel molding tools and the limiting tool are assembled in the process of preparing the rectangular flat loop heat pipe evaporator in embodiment 1.
Figure 3:
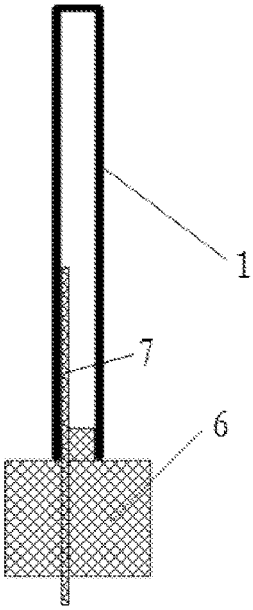
FIG. 3 is a left sectional view of an assembly formed after a shell, the steam channel molding tools and the limiting tool are assembled in the process of preparing the rectangular flat loop heat pipe evaporator in embodiment 1.
Figure 4:
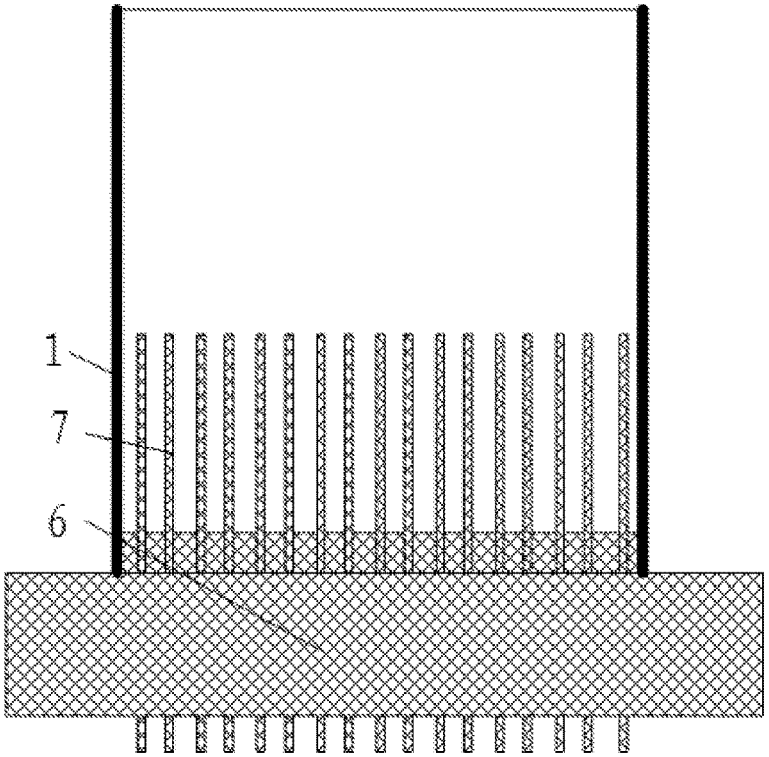
FIG. 4 is a main sectional view of an assembly formed after the shell, the steam channel molding tools and the limiting tool are assembled in the process of preparing the rectangular flat loop heat pipe evaporator in embodiment 1.
Figure 5:
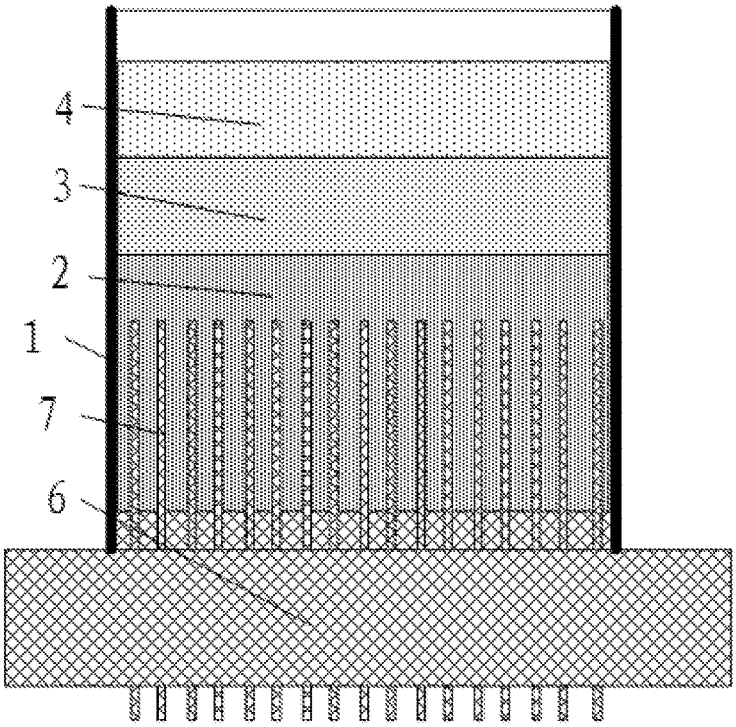
FIG. 5 is a main sectional view of an assembly formed after the shell, the steam channel molding tools, the limiting tool and a composite capillary core material are assembled in the process of preparing the rectangular flat loop heat pipe evaporator in embodiment 1.
Figure 6:
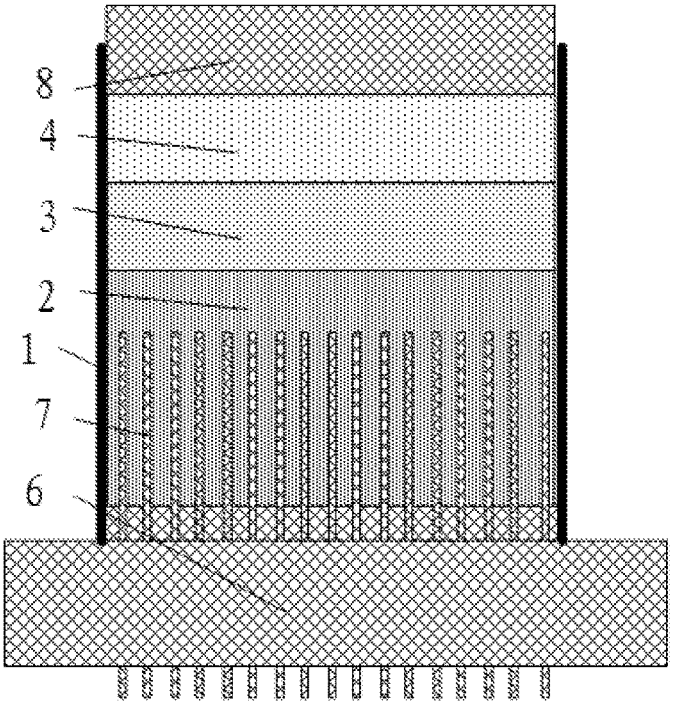
FIG. 6 is a main sectional view of an assembled mould and the composite capillary core material in the process of preparing the rectangular flat loop heat pipe evaporator in embodiment 1.
Figure 7:
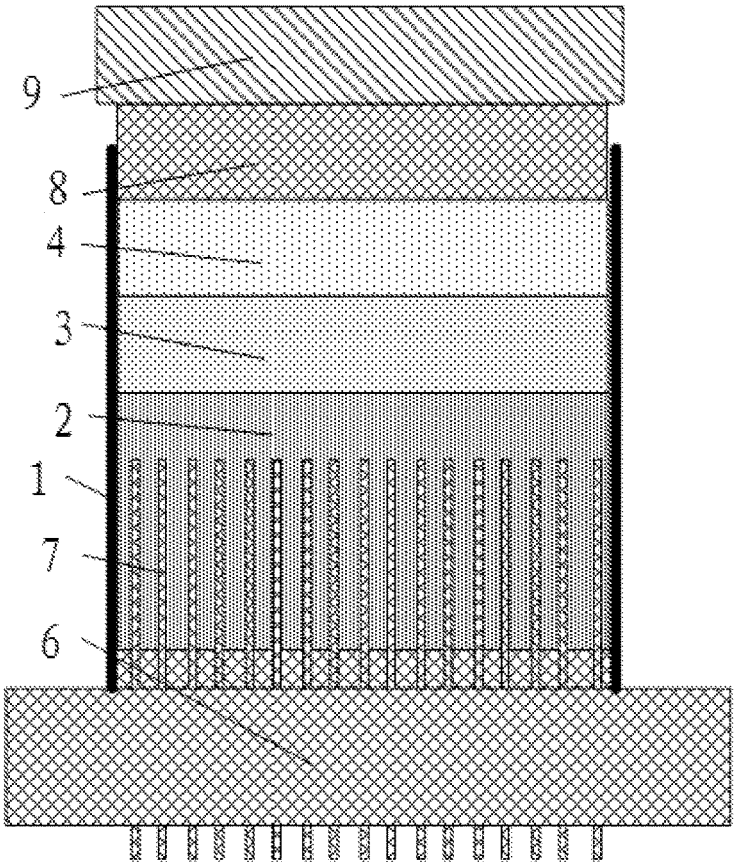
FIG. 7 is a main sectional view of a structure when a weight is applied to the assembled mould and the composite capillary core material in the process of preparing the rectangular flat loop heat pipe evaporator in embodiment 1.
Figure 8:
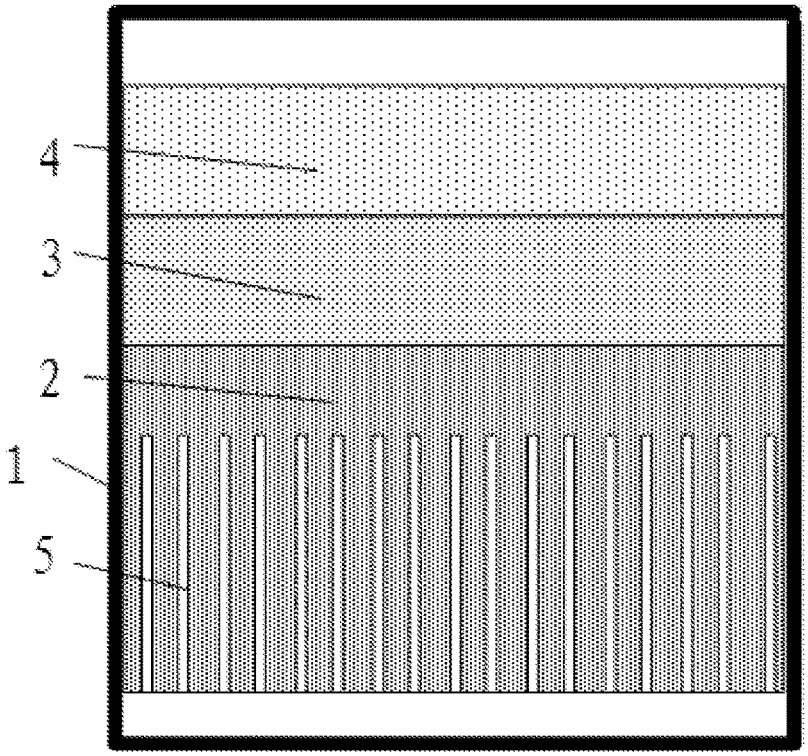
FIG. 8 is a main sectional view of the rectangular flat loop heat pipe evaporator prepared in embodiment 1.
Figure 9:
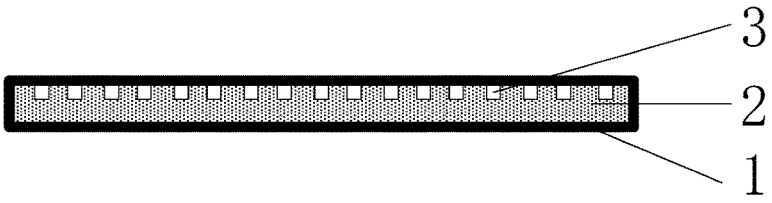
FIG. 9 is a bottom sectional view of the rectangular flat loop heat pipe evaporator prepared in embodiment 1.

A rectangular flat loop heat pipe evaporator 14 includes a shell 1 that is rectangular, has a length of 30 mm, a width of 60 mm, a height of 2 mm and a thickness of 0.5 mm and is made of stainless steel, and a mould composed of a limiting tool 6, steam channel molding tools 7 and a pressure application tool 8. The bottom of the limiting tool 6 is rectangular, the limiting tool 6 is provided with a rectangular limiting boss, the limiting boss can be sleeved with the shell 1 and can be tightly fitted with the shell 1, the seventeen steam channel molding tools 7 are strip-shaped, each having a square cross-section having a dimension of 1 mm×1 mm, and the pressure application tool 8 is fittedly put into the shell 1 and to form a tight contact; and the preparation method comprises the steps as follows:

(1) fixedly assembling the steam channel molding tools 7 on the limiting tool 6, orderly arranging the steam channel molding tools 7 at the side close to the limiting boss, and extending the tops of the steam channel molding tools 7 out of the limiting boss for 20 mm, as shown in FIG. 1 and FIG. 2; fixing the shell 1 on the limiting boss of the limiting tool 6, and making the steam channel molding tools 7 cling to the inner wall surface of the shell 1 of the evaporator 14, as shown in FIG. 3 and FIG. 4;

(2) filling the shell 1 with 500-mesh spherical copper powder serving as a material of an evaporation core 2, carrying out uniform compaction, making the height 5 mm greater than that of the steam channel molding tool 7, and making the side provided with the steam channels 5 of the material of the evaporation core 2 in tight contact with the steam channel molding tools 7;

(3) filling the upper part of the material of the evaporation core 2 with 500-mesh spherical stainless steel powder serving as a material of a heat insulation core 3, carrying out uniform compaction, and keeping the height at 3 mm;

(4) filling the upper part of the material of the heat insulation core 3 with 300-mesh spherical copper powder serving as a material of a transmission core 4, carrying out uniform compaction, and keeping the height at 3 mm, as shown in FIG. 5;

(5) inserting the pressure application tool 8 into the shell 1 at the upper part of the transmission core 4, putting the pressure application tool to the upper part of the outer side of the material of the transmission core 4, and making the top of the pressure application tool 8 higher than the shell 1 to obtain an assembled mould and a composite capillary core material, as shown in FIG. 6;

(6) applying a weight 9 to the pressure application tool 8, as shown in FIG. 7, wherein the pressure applied to the composite capillary core material by the weight 9 is 3 $kg/cm^2$; carrying out solid solution sintering on the material in a high-temperature sintering furnace at the sintering temperature of 750° C., preserving the heat for 1 h, keeping the temperature ramping rate at 10° C./min, introducing flowing hydrogen to the high-temperature sintering furnace in a sintering process, keeping the gas flow at 2 ml/min, and carrying out natural cooling for molding after ending sintering; and (7) after molding, removing the limiting tool 6, the pressure application tool 8, the weight 9 and the steam channel molding tools 7, and packaging the top of the shell 1 to obtain the rectangular flat loop heat pipe evaporator 14, wherein the thickness of the evaporation core 2 is 25 mm, the thickness of the heat insulation core 3 is 3 mm, and the thickness of the transmission core 4 is 3 mm, as shown in FIG. 8 and FIG. 9.

The performance of the loop heat pipe evaporator 14 prepared in the embodiment is tested, and the test result is as follows:

(1) Capillary Force Testing:

The capillary force is 33.0 kPa.

(2) Heat Transfer Capability Testing:

The evaporator 14 is connected to the heat transfer capability testing system, the system is normally started after 5 s, the operation temperature of the evaporator 14 is 30° C., and the ultimate heat transfer capability is greater than 100 W.

In addition, judging from the characteristic that the transmission of a liquid with high permeability is realized according to the heat conducting coefficient of the material adopted by the composite capillary core and large-particle-size powder sintering in the embodiment, the loop heat pipe evaporator 14 prepared in the embodiment has the characteristics of good heat conductivity and high permeability.

Embodiment 2

Figure 10:
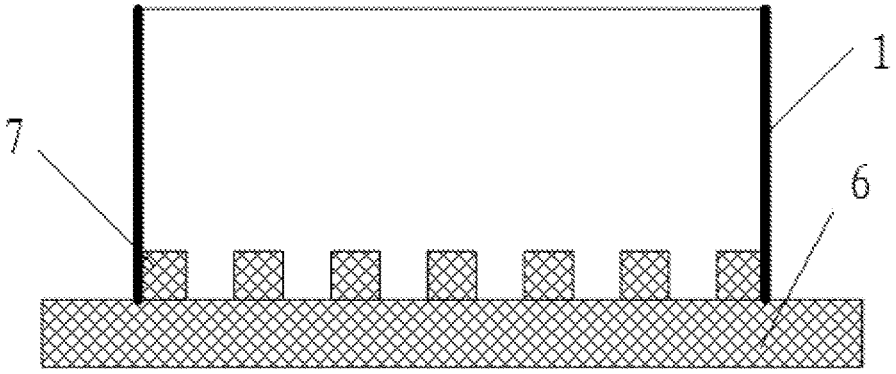
FIG. 10 is a main sectional view of an assembly formed after the shell and the limiting tool with the steam channel molding tools are assembled in a process of preparing a disc-shaped flat loop heat pipe evaporator in embodiment 2.
Figure 11:
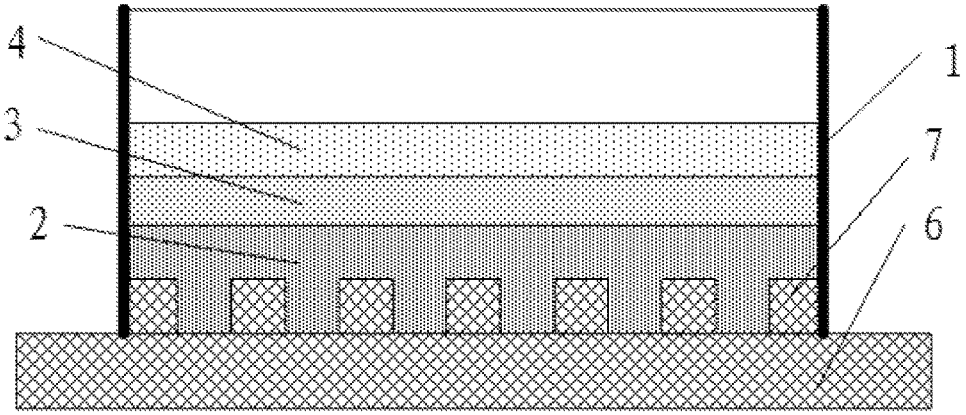
FIG. 11 is a main sectional view of an assembly formed after the shell, the limiting tool with the steam channel molding tools and the composite capillary core material are assembled in the process of preparing the disc-shaped flat loop heat pipe evaporator in embodiment 2.
Figure 12:
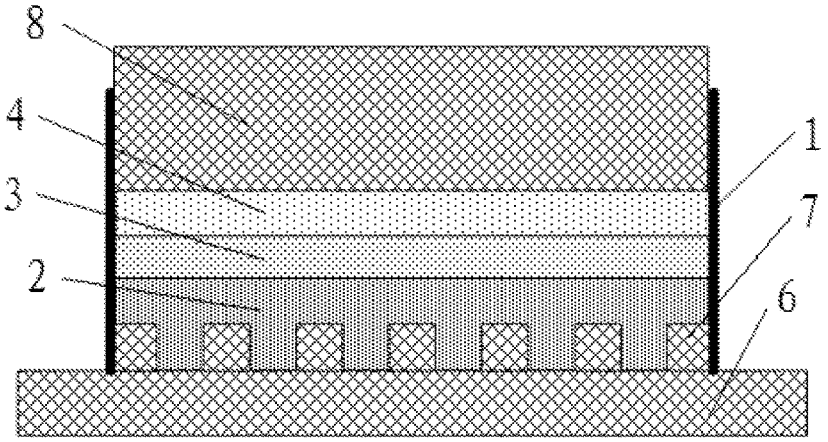
FIG. 12 is a main sectional view of the assembled mould and the composite capillary core material in the process of preparing the disc-shaped flat loop heat pipe evaporator in embodiment 2.
Figure 13:
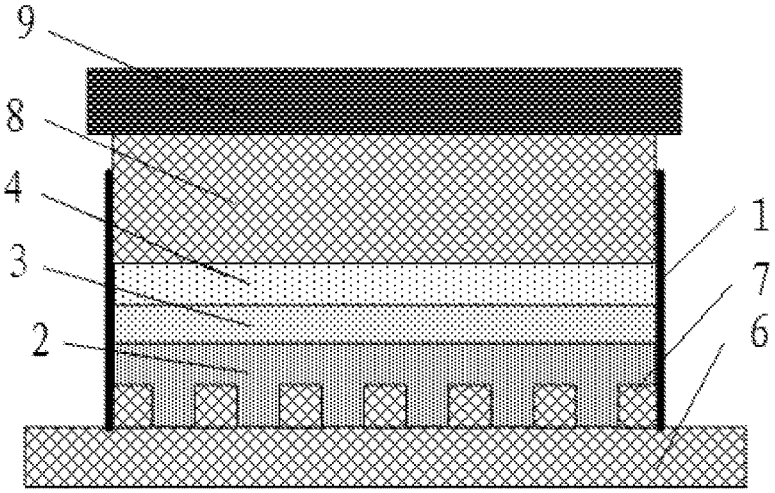
FIG. 13 is a main sectional view that the weight is applied to the assembled mould and the composite capillary core material in the process of preparing the disc-shaped flat loop heat pipe evaporator in embodiment 2.
Figure 14:
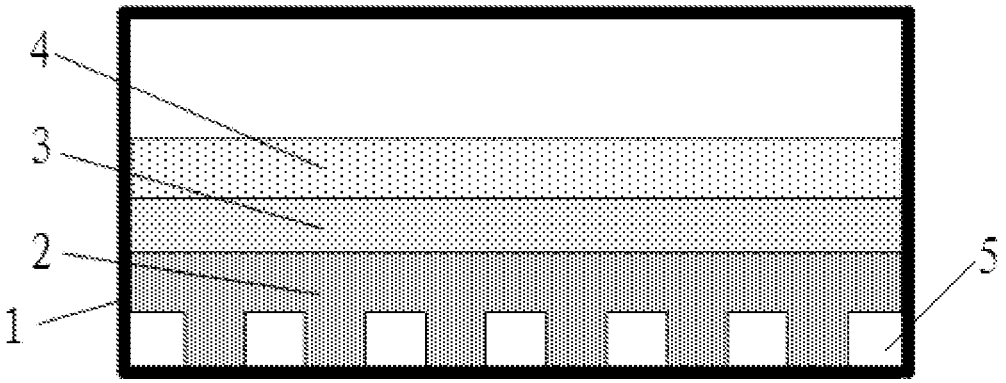
FIG. 14 is a main sectional view of the disc-shaped flat loop heat pipe evaporator prepared in embodiment 2.
Figure 15:
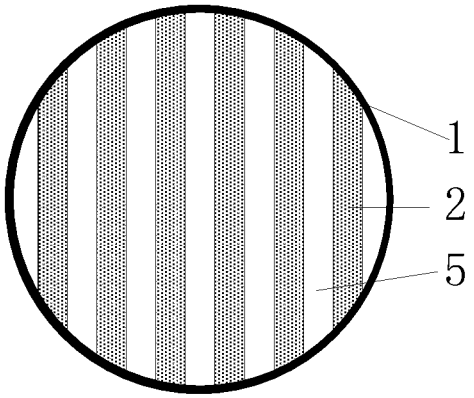
FIG. 15 is a bottom sectional view of the disc-shaped flat loop heat pipe evaporator prepared in embodiment 2.

A disc-shaped flat loop heat pipe evaporator 14, having a cylindrical shell 1 having a diameter of 25 mm, a height of 1 cm and a thickness of 0.5 mm and made of stainless steel, and a mould composed of a limiting tool 6, steam channel molding tools 7 and a pressure application tool 8, wherein the limiting tool 6 is disc-shaped, the steam channel molding tools 7 are processed on the surface of the limiting tool 6, the steam channel molding tools 7 include seven square bulges, each having a cross-sectional dimension of 1 mm×1 mm, and have disc-shaped peripheral outlines. The steam channel molding tools 7 can be fittedly sleeved with the shell 1, and the pressure application tool 8 can be fittedly put into the shell 1 to form a tight contact; and the preparation method comprises the steps as follows:

(1) fixedly assembling the steam channel molding tools 7 on the limiting tool 6, orderly arranging the steam channel molding tools 7 at the side close to the limiting boss, and keeping the heights of the steam channel molding tools 7 at 1 mm; fixing the shell 1 on the limiting tool 6, as shown in FIG. 9;

(2) filling the shell 1 with 500-mesh spherical copper powder serving as a material of an evaporation core 2, carrying out uniform compaction, making the height 3 mm greater than that of the steam channel molding tool 7, and making the side provided with the steam channels 5 of the material of the evaporation core 2 in tight contact with the steam channel molding tools 7;

(3) filling the upper part of the material of the evaporation core 2 with 300-mesh spherical titanium powder serving as a material of a heat insulation core 3, carrying out uniform compaction, and keeping the height at 2 mm;

(4) filling the upper part of the material of the heat insulation core 3 with 200-mesh spherical copper powder serving as a material of a transmission core 4, carrying out uniform compaction, and keeping the height at 2 mm, as shown in FIG. 10;

(5) inserting the pressure application tool 8 into the shell 1 at the upper part of the transmission core 4, putting the pressure application tool to the upper part of the outer side of the material of the transmission core 4, and making the top of the pressure application tool 8 higher than the shell 1 to obtain an assembled mould and a composite capillary core material, as shown in FIG. 11;

(6) applying a weight 9 to the pressure application tool 8, as shown in FIG. 12, wherein the pressure applied to the composite capillary core material by the weight 9 is 3 $kg/cm^2$; carrying out vacuum solid solution sintering on the material in a high-temperature sintering furnace at the sintering temperature of 750° C., preserving the heat for 1 h, keeping the temperature ramping rate at 10° C./min, and carrying out natural cooling for molding after ending sintering; and (7) after molding, removing the limiting tool 6 with the steam channel molding tools 7, the pressure application tool 8 and the weight 9, and packaging the top of the shell 1 to obtain the disc-shaped flat loop heat pipe evaporator 14, wherein the thickness of the evaporation core 2 is 4 mm, the thickness of the heat insulation core 3 is 2 mm, and the thickness of the transmission core 4 is 2 mm, as shown in FIG. 13.

The performance of the loop heat pipe evaporator 14 prepared in the embodiment is tested, and the test result is as follows:

(1) Capillary Force Testing:

The capillary force is 34.2 kPa.

(2) Heat Transfer Capability Testing:

The evaporator 14 is connected to the heat transfer capability testing system, the system is normally started after 16 s, the operation temperature of the evaporator 14 is 50° C., and the ultimate heat transfer capability is greater than 60 W.

In addition, known from the characteristic that the transmission of a liquid with high permeability is realized according to the heat conducting coefficient of the material adopted by the composite capillary core and large-particle-size powder sintering in the embodiment, the loop heat pipe evaporator 14 prepared in the embodiment has the characteristics of good heat conductivity and high permeability.

Embodiment 3

Figure 16:
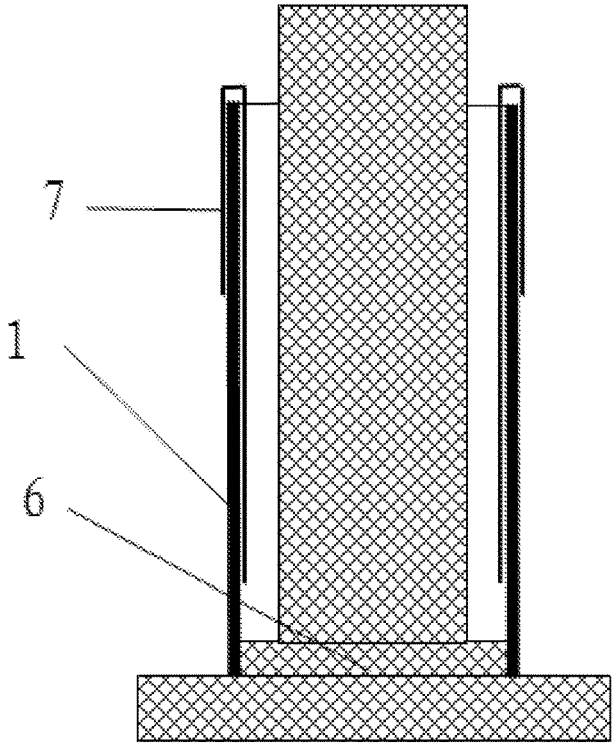
FIG. 16 is a main sectional view of an assembly formed after the shell, the steam channel molding tools and the limiting tool provided with an evaporation core hole forming column are assembled in a process of preparing a cylindrical loop heat pipe evaporator in embodiment 3.
Figure 17:
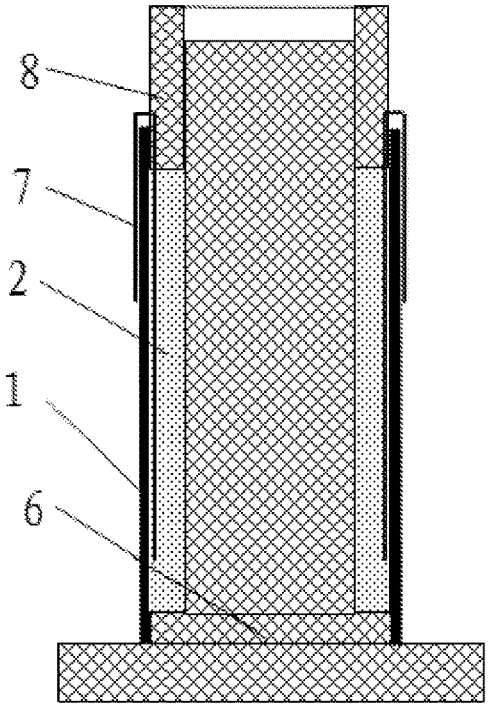
FIG. 17 is a main sectional view of an assembly formed after a powder material of the evaporation core is filled and an evaporation core pressure application tool is additionally arranged in the process of preparing the cylindrical loop heat pipe evaporator in embodiment 3.
Figure 18:
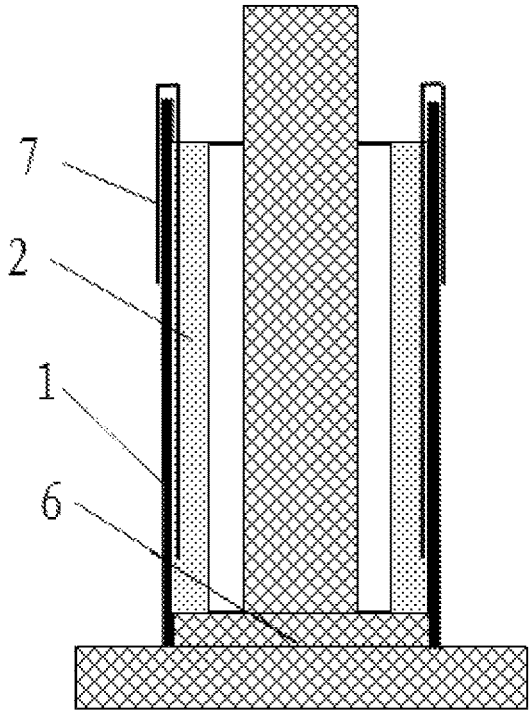
FIG. 18 is a main sectional view of an assembly formed after the evaporation core pressure application tool is removed and a heat insulation core hole forming column is assembled at the bottom of the shell after replacing a hole forming column of the limiting tool in the process of preparing the cylindrical loop heat pipe evaporator in embodiment 3.
Figure 19:
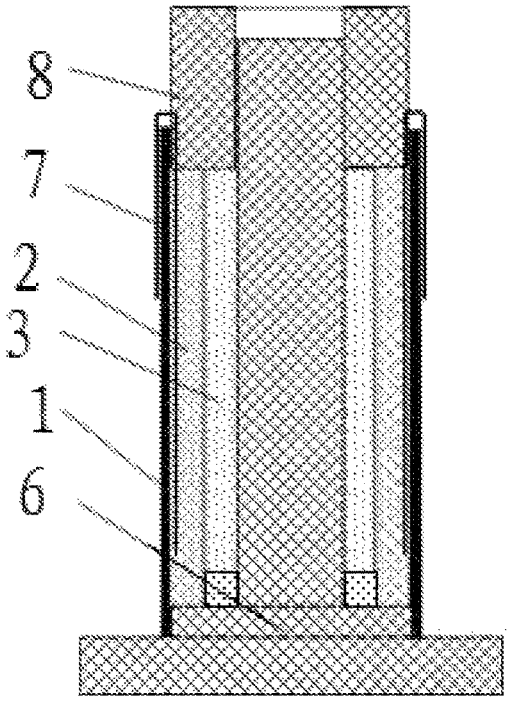
FIG. 19 is a main sectional view of an assembly formed after the powder materials of the evaporation core and the heat insulation core are filled and a heat insulation core pressure application tool is additionally arranged in the process of preparing the cylindrical loop heat pipe evaporator in embodiment 3.
Figure 20:
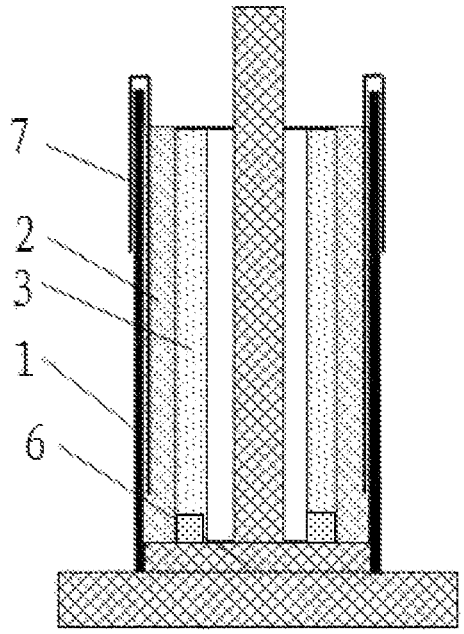
FIG. 20 is a main sectional view of an assembly formed after the heat insulation core pressure application tool is removed and a transmission core hole forming column is assembled at the bottom of the shell after replacing the hole forming column of the limiting tool in the process of preparing the cylindrical loop heat pipe evaporator in embodiment 3.
Figure 21:
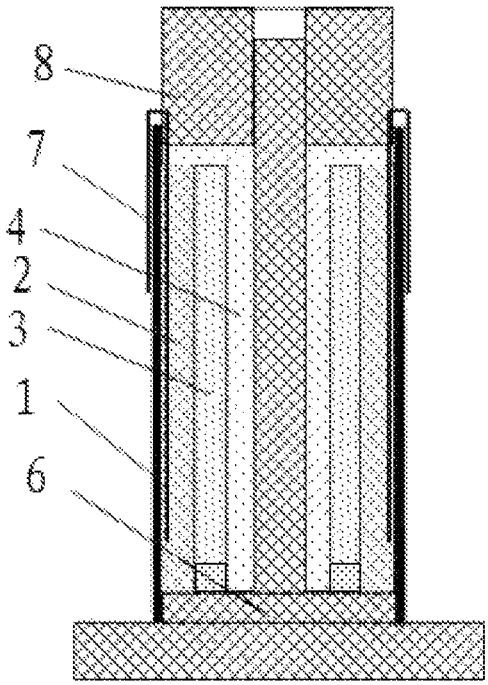
FIG. 21 is a main sectional view of the assembled mould and the composite capillary core material in the process of preparing the cylindrical loop heat pipe evaporator in embodiment 3.
Figure 22:
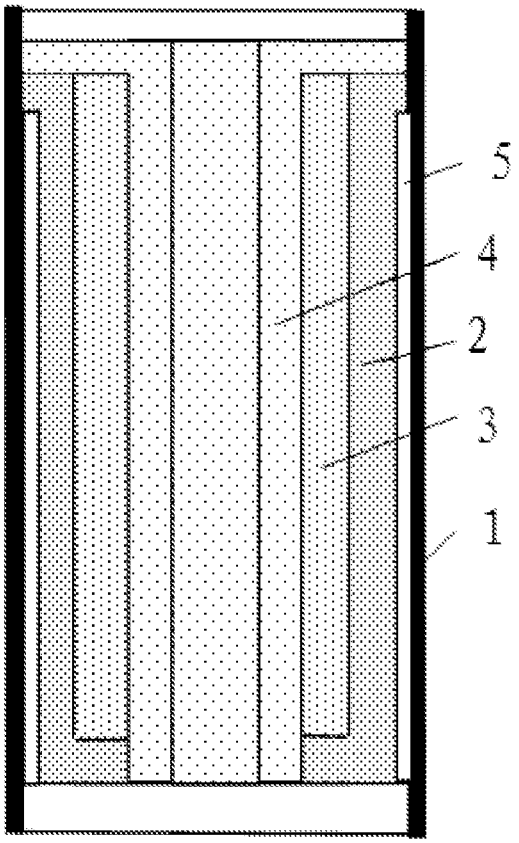
FIG. 22 is a main sectional view of the cylindrical loop heat pipe evaporator prepared in embodiment 3.
Figure 23:
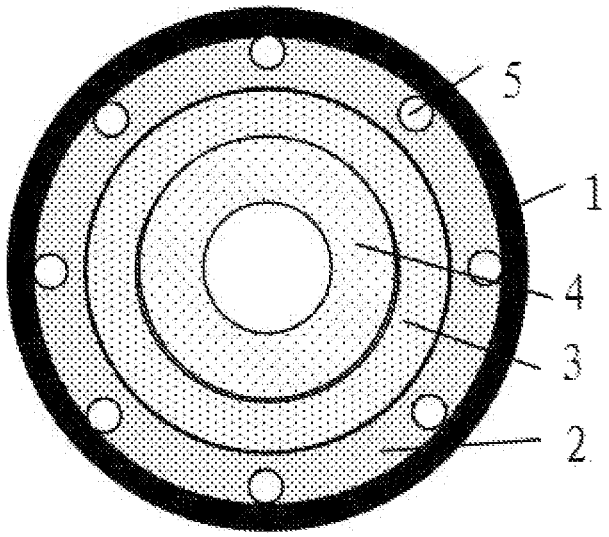
FIG. 23 is a bottom sectional view of the cylindrical loop heat pipe evaporator prepared in embodiment 3.

A cylindrical loop heat pipe evaporator 14 includes a shell 1 which is cylindrical, has a diameter of 13 mm, a height of 100 mm and a thickness of 0.5 mm and is made of stainless steel, and a mould composed of a limiting tool 6, steam channel molding tools 7 and a pressure application tool 8 is adopted, wherein the bottom of the limiting tool 6 is cylindrical, the limiting tool 6 is provided with a cylindrical limiting boss on which a cylindrical hole forming column is formed, the hole forming column is an evaporation core hole forming column, a heat insulation core hole forming column and a transmission core hole forming column of which the diameters are arranged from large to small and are respectively matched with inner hole diameters of an evaporation core 2, a heat insulation core 3 and a transmission core 4, the steam channel molding tools 7 are structurally composed of eight cylinders with the diameters of 1 mm and the lengths of 80 mm, the tops are provided with bends hung on the shell 1, the pressure application tool 8 is cylindrical and is an evaporation core pressure application tool, a heat insulation core pressure application tool and a transmission core pressure application tool of which the inner hole diameters are arranged from large to small and are respectively matched with the diameters of the evaporation core hole forming column, the heat insulation core hole forming column and the transmission core hole forming column, the pressure application tool 8 has the external diameter meeting the requirement that the pressure application tool 8 can be just put into the shell 1 and can be tightly matched, and inner hole can be used for inserting the hole forming column; and the preparation method comprises the steps as follows:

when the evaporator 14 is cylindrical, the preparation method can include the specific steps as follows:

(1) combining and assembling the bottom of the shell (1) and the limiting boss of the limiting tool 6; at this time, the hole forming column on the limiting tool 6 is the evaporation core hole forming column; a gap is formed between the shell 1 and the evaporation core hole forming column, wherein the gap is of a cylindrical structure and is used for filling a powder material of the evaporation core 2; hanging the steam channel molding tools 7 on the shell 1, keeping a 1 cm distance from the steam channel molding tools 7 to the bottom of the limiting tool 6 of the evaporation core 2, uniformly distributing eight steam channel molding tools 7 around the shell 1, and fitting the steam channel molding tools 7 to the inner wall surface of the shell 1, as shown in FIG. 16;

(2) filling the gap in step (1) with 800-mesh spherical nickel powder serving as a material of the evaporation core 2, inserting the evaporation core pressure application tool into the shell 1 at the upper part of the material of the evaporation core 2, wherein an inner hole of the evaporation core pressure application tool can be used for inserting the evaporation core hole forming column; applying a pressure with the intensity of 3 kg/cm$^2$ to compact the material of the evaporation core 2, making the height of the material of the compacted evaporation core 2 1 cm smaller than that of the shell 1, and making the thickness of the material 2 mm, as shown in FIG. 17;

(3) removing the limiting tool 6 and the evaporation core pressure application tool, replacing the hole forming column with the heat insulation core hole forming column, then, assembling the limiting tool 6 to the bottom of the shell 1, and keeping a gap between the shell 1 and the heat insulation core hole forming column, wherein the gap is of a cylindrical structure and is used for filling a material of the heat insulation core 3, as shown in FIG. 18;

(4) firstly filling the gap in step (3) with 800-mesh spherical nickel powder serving as the material of the evaporation core 2 (having a thickness at 5 mm), then, filling the gap in step (3) with 100-mesh spherical alumina powder serving as the material of the heat insulation core 3, inserting the heat insulation core pressure application tool into the shell 1 at the upper part of the material of the heat insulation core 3, wherein an inner hole of the heat insulation core pressure application tool can be used for inserting the heat insulation core hole forming column; applying a pressure with the intensity of 3 kg/cm$^2$ to compact the material of the heat insulation core 3, making the height of the material of the compacted heat insulation core 3 1 cm smaller than that of the shell 1, and making the thickness of the material 1 mm, as shown in FIG. 19;

(5) removing the limiting tool 6 and the heat insulation core pressure application tool, replacing the hole forming column with the transmission core hole forming column, then, assembling the limiting tool 6 to the bottom of the shell 1, and keeping a gap between the shell 1 and the transmission core hole forming column, wherein the gap is of a cylindrical structure and is used for filling a material of the transmission core 4, as shown in FIG. 20;

(6) filling the gap with the cylindrical structure in step (3) with 100-mesh spherical nickel powder serving as the material of the transmission core 4, inserting the transmission core pressure application tool into the shell 1 at the upper part of the material of the transmission core 4, wherein an inner hole of the transmission core pressure application tool can be used for inserting the transmission core hole forming column; applying a pressure with the intensity of 3 kg/cm$^2$ to compact the material of the transmission core 4, making the height of the material of the compacted transmission core 4 5 mm greater than the heights of the heat insulation core 3 and the evaporation core 2, making the thickness of the material 1 mm, and coating the outer sides of the tops of the evaporation core 2 and the heat insulation core 3 to obtain an assembled mould and a composite capillary core material, as shown in FIG. 21;

(7) putting the assembled mould and the composite capillary core material into a sintering furnace, applying a weight 9 on the pressure application tool 8, wherein the pressure applied to the composite capillary core material by the weight 9 is 3 kg/cm$^2$; carrying out solid solution sintering on the material in a high-temperature sintering furnace at the sintering temperature of 950° C., preserving the heat for 1 h, keeping the temperature ramping rate at 10° C./min, introducing flowing hydrogen to the high-temperature sintering furnace in a sintering process, controlling the gas flow at 2 ml/min, and carrying out natural cooling for molding after ending sintering; and (8) demolding after molding, and packaging the top of the shell 1 to obtain a cylindrical loop heat pipe evaporator 14, wherein the thickness of the evaporation core 2 is 2 mm, the thickness of the heat insulation core 3 is 1 mm, and the thickness of the transmission core 4 is 1 mm, as shown in FIG. 22 and FIG. 23.

The performance of the loop heat pipe evaporator 14 prepared in the embodiment is tested, and the test result is as follows:

(1) Capillary Force Testing:

The capillary force is 41 kPa.

(2) Heat Transfer Capability Testing:

The evaporator 14 is connected to the heat transfer capability testing system, the system is normally started after 11 s, the operation temperature of the evaporator 14 is 40° C., and the ultimate heat transfer capability is greater than 300 W.

In addition, judging from the characteristic that the transmission of a liquid with high permeability is realized according to the heat conducting coefficient of the material adopted by the composite capillary core and large-particle-size powder sintering in the embodiment, the loop heat pipe evaporator 14 prepared in the embodiment has the characteristics of good heat conductivity and high permeability.

The invention claimed is:

1. A preparation method of a loop heat pipe evaporator, wherein the method is a hot-press sintering method comprising the steps of:

putting a shell (1) of the evaporator (14) into a mould, then, uniformly and compactly filling corresponding positions in the mould with material powders of an evaporation core (2), a heat insulation core (3) and a transmission core (4), applying a pressure high enough to tightly fit the evaporation core (2) and the transmission core (4) to the shell (1) at corresponding sintering temperatures of powder materials for the evaporation core (2) and the transmission core (4), carrying out hot-press sintering for molding, carrying out cooling after making the powder materials of the evaporation core (2) and the transmission core (4) form metallurgical bonding, and carrying out demolding to obtain the loop heat pipe evaporator (14); the evaporation core (2) being provided with steam channels (5) and the mould being provided with structures corresponding to the steam channels (5) on positions evaporation core (2) are provided with the steam channels (5);

the evaporator (14) being composed of the shell (1) and a composite capillary core; the composite capillary core being formed by sequentially compounding three layers including the evaporation core (2), the heat insulation core (3) and the transmission core (4); the heat insulation core (3) being located between the evaporation core (2) and the transmission core (4); a first side not adjacent to the heat insulation core (3) of the evaporation core (2) being provided with the steam channels (5), and a second side not adjacent to the heat insulation core (3) of the transmission core (4) being close to a liquid storage device of a loop heat pipe; the evaporation core (2) and the transmission core (4) being made of the same material whose heat conducting coefficient is larger than that of the material of the heat insulation core (3) and whose melting point is lower than that of the material of the heat insulation core (3); the melting point of the material of the shell (1) being greater than or equal to that of the material of the evaporation core (2) and the transmission core (4);

all the evaporation core (2), the transmission core (4) and the heat insulation core (3) using powder materials, the evaporation core (2) and the transmission core (4) being molded by hot-press sintering and tightly fitted to a wall surface of the shell (1) to form a seal, and the heat insulation core (3) being kept in a powdery state; and the material of the transmission core (4) having a particle size is larger than or equal to that of the material of the evaporation core (2).

2. The preparation method of the loop heat pipe evaporator of claim 1, wherein the mould comprises a limiting tool (6), steam channel molding tools (7) and a pressure application tool (8).

3. The preparation method of the loop heat pipe evaporator of claim 2, wherein when the evaporator (14) is a rectangular flat evaporator or a disc-shaped flat evaporator, and the preparation method comprises the steps as follows:

(a) assembling the steam channel molding tools (7) on the limiting tool (6), and fixing the shell (1) on the limiting tool (6);

(b) uniformly and compactly filling the shell (1) with the powder material of the evaporation core (2), and making the first side, provided with the steam channels (5), of the evaporation core (2) be in tight contact with the steam channel molding tools (7);

(c) uniformly and compactly filling the second side, not provided with the steam channels (5), of the evaporation core (2) in the shell (1) with the powder material of the heat insulation core (3);

(d) uniformly and compactly filling one side of the heat insulation core (3) in the shell (1) with the powder material of the transmission core (4);

(e) inserting the pressure application tool (8) into the shell (1), and putting the pressure application tool (8) to an outer side of the material of the transmission core (4) to obtain an assembled mould and a composite capillary core material;

(f) putting the assembled mould and the composite capillary core material into a sintering furnace, and applying a pressure to an outer side of the pressure application tool (8) so as to carry out hot-press sintering for molding; and (g) carrying out demolding after molding, and packaging a top of the shell (1) to obtain a rectangular flat or disc-shaped flat loop heat pipe evaporator (14).

4. The preparation method of the loop heat pipe evaporator of claim 2, wherein when the evaporator (14) is a cylindrical evaporator, the preparation method comprises the steps as follows:

(a) combining the shell (1) with the limiting tool (6) to form a gap with a cylindrical structure, fixing the steam channel molding tools (7), retaining distances from the bottoms of the steam channel molding tools (7) to a bottom of the limiting tool (6), distributing more than one of the steam channel molding tools (7) around the shell (1), and fitting the more than one of the steam channel molding tools (7) to an inner wall surface of the shell (1);

(b) filling the gap formed by combining the shell (1) and the limiting tool (6) with the powder material of the evaporation core (2), applying a pressure by using the pressure application tool (8) to compact the powder material of the evaporation core (2) such that the compacted evaporation core (2) has a height smaller than that of the shell (1);

(c) removing the limiting tool (6) from the evaporation core (2), mounting the limiting tool (6) to the heat insulation core (3), and retaining a gap with a cylindrical structure between the limiting tool (6) and the filled evaporation core (2);

(d) firstly filling the gap with the cylindrical structure in step (c) with the powder material of the evaporation core (2), then, filling the gap with the powder material of the heat insulation core (3), applying a pressure by the pressure application tool (8) to compact the powder material of the heat insulation core (3) such that the compacted evaporation core (3) has a height equal to that of the evaporation core (2);

(e) removing the limiting tool (6) from the heat insulation core (3), mounting the limiting tool (6) to the transmission core (4), and retaining a gap with a cylindrical structure between the limiting tool (6) and the filled evaporation core (2) and heat insulation core (3);

(f) filling the gap with the cylindrical structure in step (4) with the powder material of the transmission core (4), applying a pressure by the pressure application tool (8) to compact the powder material of the heat insulation core (3), such that the transmission core (4) has a height larger than that of the heat insulation core (3) and that of the evaporation core (2), and coating outer sides of the tops of the evaporation core (2) and the heat insulation core (3) to obtain an assembled mould and a composite capillary core material;

(g) putting the assembled mould and the composite capillary core material into the sintering furnace, and applying a pressure to an outer side of the pressure application tool (8) so as to carry out hot-press sintering for molding; and (h) carrying out demolding after molding, and packaging a top of the shell (1) to obtain a cylindrical loop heat pipe evaporator (14).

5. The preparation method of the loop heat pipe evaporator of claim 1, wherein the particle size of the powder material adopted by the evaporation core (2) is 300-1000 meshes, the particle size of the powder material adopted by the transmission core (4) is 50-300 meshes, and the particle size of the powder material adopted by the heat insulation core (3) is 50-300 meshes.

6. The preparation method of the loop heat pipe evaporator of claim 5, wherein the heat conducting coefficient of the material of the evaporation core (2) and the transmission core (4) is one order of magnitude different from that of the material of the heat insulation core (3); the difference of the melting point of the material of the heat insulation core (3) and the melting point of the material of the evaporation core (2) and the transmission core (4) is larger than 100° C.; the evaporator (14) is a rectangular flat evaporator, a disc-shaped flat evaporator, or a cylindrical evaporator; the steam channels (5) are rectangular, circular or trapezoidal; and the thickness of the shell (1) of the evaporator (14) is smaller than 1 mm.

7. The preparation method of the loop heat pipe evaporator of claim 6, wherein the material of the evaporation core (2) and the transmission core (4) is copper, nickel or aluminum, and the material of the heat insulation core (3) is stainless steel, titanium, titanium alloy or a metal oxide.

8. The preparation method of the loop heat pipe evaporator of claim 6, wherein the steam channels (5) are circular and are uniformly distributed on the evaporation core (2).

* * * * *